US011373834B2

(12) United States Patent
Bhosale

(10) Patent No.: US 11,373,834 B2
(45) Date of Patent: Jun. 28, 2022

(54) APPARATUS FOR GENERATING ELECTROMAGNETIC WAVES

(71) Applicant: Devesh S. Bhosale, Aurangabad (IN)

(72) Inventor: Devesh S. Bhosale, Aurangabad (IN)

(73) Assignee: Devesh S. Bhosale, Aurangabad (IN)

( * ) Notice: Subject to any disclaimer, the term of this patent is extended or adjusted under 35 U.S.C. 154(b) by 613 days.

(21) Appl. No.: 16/319,622

(22) PCT Filed: Jul. 19, 2017

(86) PCT No.: PCT/IB2017/054359
§ 371 (c)(1),
(2) Date: Jan. 22, 2019

(87) PCT Pub. No.: WO2018/015896
PCT Pub. Date: Jan. 25, 2018

(65) Prior Publication Data

US 2021/0280384 A1 Sep. 9, 2021

(30) Foreign Application Priority Data

Jul. 22, 2016 (IN) ..... 201621025232

(51) Int. Cl.
*H01J 23/10* (2006.01)
*H01J 23/12* (2006.01)

(52) U.S. Cl.
CPC ..... *H01J 23/10* (2013.01); *H01J 23/12* (2013.01)

(58) Field of Classification Search
CPC ..... H01J 23/10
See application file for complete search history.

(56) References Cited

U.S. PATENT DOCUMENTS 5,818,170 A 10/1998 Kikunaga et al.

OTHER PUBLICATIONS

International Search Report related to Application No. PCT/IB2017/054359 reported on Sep. 22, 2017.

*Primary Examiner* — Joseph L Williams
(74) *Attorney, Agent, or Firm* — von Briesen & Roper, s.c.

(57) ABSTRACT

An apparatus for generating electromagnetic waves is envisaged relating to the field of electromagnetic wave generating systems. The apparatus provides efficient radio frequency amplification, facilitates low loss electromagnetic generation, enables efficient utilization of kinetic energy of electrons, and works for different radio frequencies. The apparatus comprises an evacuated envelope, a pair of metal plates, a resonator, an electron gun, a magnetic field generator, and a pick-up loop. The evacuated envelope defines a space therewithin. The pair of metal plates defines a passage therebetween. The resonator is coupled to the pair of metal plates. The electron gun emits controlled bursts of electrons into the passage. The magnetic field generator is configured to generate electromagnetic waves. The pick-up loop extracts the generated electromagnetic waves.

8 Claims, 10 Drawing Sheets

APPARATUS FOR GENERATING ELECTROMAGNETIC WAVES

CROSS-REFERENCE TO RELATED APPLICATION

This Application is a 35 USC § 371 US National Stage filing of International Application No. PCT/IB2017/054359 filed on Jul. 19, 2017, and claims priority under the Paris Convention to Indian Patent Application No. 201621025232 filed on Jul. 22, 2016.

FIELD OF THE DISCLOSURE

The present disclosure relates to electromagnetic wave generating systems.

BACKGROUND OF THE DISCLOSURE

Conventional microwave amplification tubes like travelling wave tubes (TWTs) and Klystrons are used to obtain amplified RF signals. A TWT is an elongated vacuum tube having a magnetic field around the tube. An electron gun present at one end of the tube emits electrons which are focused by the magnetic field to form an electron beam that is passed through a helix wire placed in the middle of the tube. The helix wire stretches from an RF input to an RF output, through which the electron beam is passed. A potential is applied at the anode and cathode of the tube which along with the magnetic field helps in acceleration of the electron beam towards a Collector electrode end of the tube where the Collector electrode returns the electrons to the circuit. A Klystron is similar to the TWT. Instead of a helix or coupled cavities present in TWT, the Klystron includes a plurality of cavity resonators to produce velocity modulation of the electron beam for amplification. However, if any portion of the TWT or the Klystron output signal reflects back to the input, it causes oscillations within the tube which decrease the amplification. Attenuators can be placed to minimize the reflections, but the attenuators result in reduced gain which affects overall efficiency of the tube. Also, most of the energy in both Klystrons and TWTs is lost as heat in the Collector electrode plate. Moreover, TWTs and Klystrons require external supply of microwave to be amplified, and Klystrons are not able to provide high RF gain.

Therefore, there is a need for an electromagnetic (EM) wave generating apparatus and method that limits the aforementioned drawbacks of the conventional microwave amplification tubes and generates electromagnetic waves without input of RF signal.

SUMMARY OF THE DISCLOSURE

Some of the objects of the present disclosure, which at least one embodiment herein satisfies, are as follows:

It is an object of the present disclosure to ameliorate one or more problems of the prior art or to at least provide a useful alternative.

An object of the present disclosure is to provide an apparatus for generating electromagnetic (EM) waves.

Another object of the present disclosure is to provide an apparatus, for generating electromagnetic (EM) waves, which provides efficient radio frequency amplification.

Yet another object of the present disclosure is to provide an apparatus, for generating electromagnetic (EM) waves, which facilitates low loss EM generation.

Still another object of the present disclosure is to provide an apparatus, for generating electromagnetic (EM) waves, which enables almost complete utilization of kinetic energy of electrons.

A further object of the present disclosure is to provide an apparatus, for generating electromagnetic (EM) waves, which works for different radio frequencies.

Other objects and advantages of the present disclosure will be more apparent from the following description, which is not intended to limit the scope of the present disclosure.

An apparatus for generating electromagnetic waves is envisaged. The apparatus comprises an evacuated envelope, a pair of metal plates, a resonator, an electron gun, a magnetic field generator, and a pick-up loop. The evacuated envelope defines a space therewithin. The pair of metal plates is disposed in a spaced apart configuration within the space thereby defining a passage therebetween. The resonator is coupled to the pair of metal plates. The electron gun is configured to emit bursts of electrons into the passage in a controlled manner. The magnetic field generator is configured to generate a time varying magnetic field across the passage, thereby imparting oscillations to the electrons for inducing an oscillating electric field between the pair of metal plates. The oscillating electric field is configured to induce a time varying current in the resonator resulting in the generation of electromagnetic waves. The pick-up loop is coupled to the resonator and configured to extract the generated electromagnetic waves.

In an embodiment, the evacuated envelope is coupled between the electron gun and a Collector electrode. In another embodiment, the electron gun is selected from the group consisting of a thermionic electron gun, an electrostatic electron gun, and a laser driven electron gun. Further, in one embodiment, the bursts of electrons travel along an undulating path under the influence of the time varying magnetic field. Additionally, the bursts of electrons travel one cycle of oscillation in a fixed time period.

In one embodiment, the width of the resonator is smaller than the width of the evacuated envelope. Further, side walls of the evacuated envelope are tapered.

In another embodiment, the apparatus includes a D-shaped envelope coupled between the electron gun and at least one evacuated envelope. Further, it includes electron absorbing material disposed at each intersection formed by the at least one evacuated envelope and the perimeter of the D-shaped envelope. In yet another embodiment, the electron gun is configured to emit high velocity stream of electrons.

BRIEF DESCRIPTION OF THE ACCOMPANYING DRAWING

An apparatus and method for generating electromagnetic (EM) waves of the present disclosure will now be described with the help of the accompanying drawing, in which.

Figure 1:
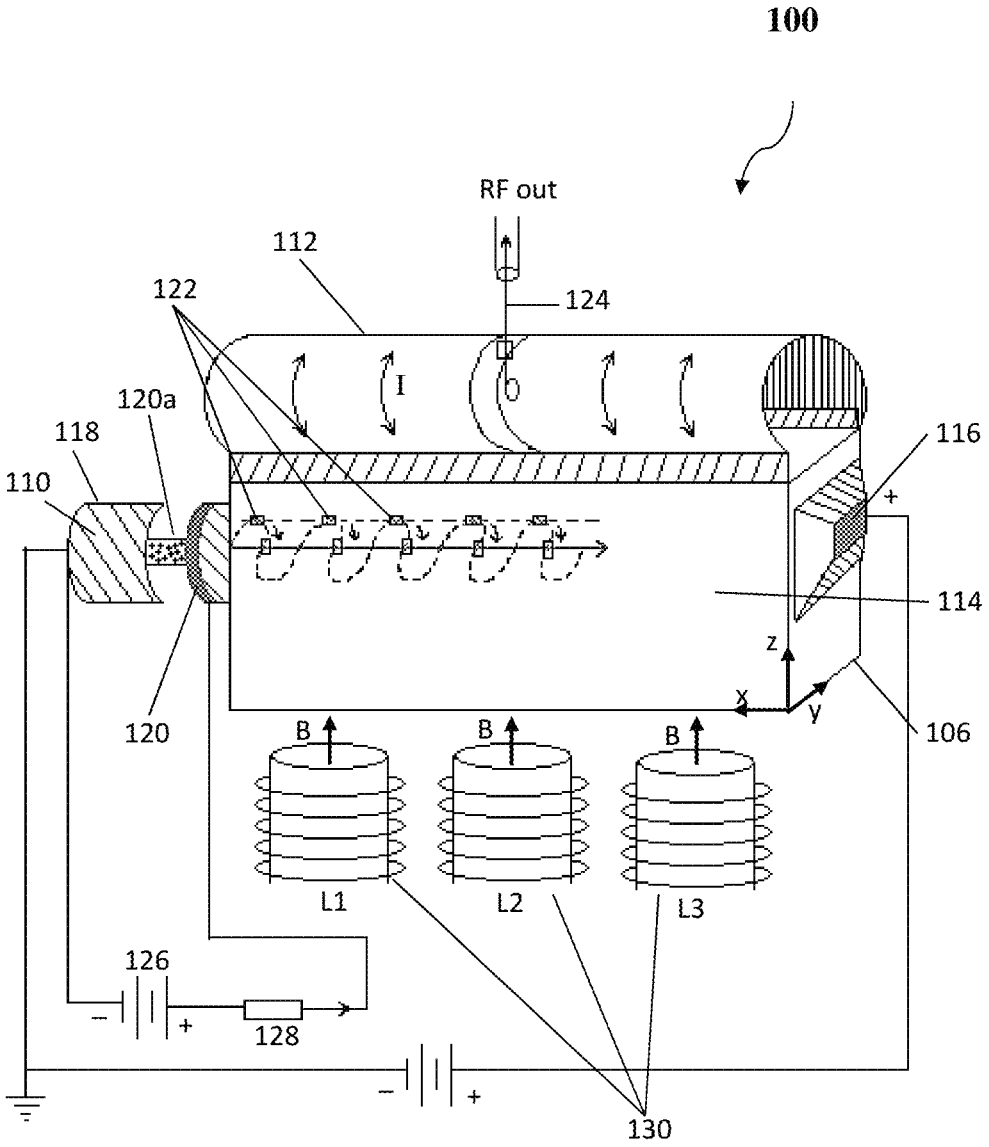
FIG. 1 illustrates a schematic diagram of an EM waves generating apparatus, in accordance with an embodiment of the present disclosure.

List and details of reference Numerals used in the description and drawing:

| Reference Numeral | Reference |
|---|---|
| 100 | EM wave generating apparatus |
| 102 | Vacuum region |
| 104 | D-shaped envelope |
| 106 | Evacuated envelope |
| 108 | Electron absorbing material |
| 110 | Electron gun |
| 112 | Resonator |
| 114 | Space |
| 116 | Collector electrode |
| 118 | Cathode |
| 120 | Anode |
| 120a | Anode cylinder |
| 122 | Bursts of electrons |
| 124 | Pick-up loop |
| 126 | Very high voltage battery |
| 128 | Battery switch |
| 130 | Magnetic field generator |
| 800 | Rectifier inverter limiter circuit |
| 802 | 3 phase AC supply |
| 804 | 6 pulse controlled rectifier |
| 806 | LC filter |
| 808 | Variable frequency inverter |
| 810 | Current limiter |
| 812 | Tank circuit |
| 900 | Magnetic field control circuit |
| 902 | Autotransformer |
| 904 | Signal processing circuit |
| 906 | Switch |
| 908 | Digital filter |
| 910 | Frequency divider |
| 912 | Analog to Digital Converter (ADC) |
| 914 | Analog filter |

DETAILED DESCRIPTION

Conventional microwave amplification tubes like travelling wave tubes (TWTs) and Klystrons are used to obtain amplified RF signals. A TWT is an elongated vacuum tube having a magnetic field around the tube. An electron gun present at one end of the tube emits electrons which are focused by the magnetic field to form an electron beam that is passed through a helix wire placed in the middle of the tube. The helix wire stretches from an RF input to an RF output, through which the electron beam is passed. A potential is applied at the anode and cathode of the tube which along with the magnetic field helps in acceleration of the electron beam towards a Collector electrode end of the tube where the Collector electrode returns the electrons to the circuit. A Klystron is similar to the TWT. Instead of a helix or coupled cavities present in TWT, the Klystron includes a plurality of space resonators to produce velocity modulation of the electron beam for amplification. However, if any portion of the TWT or the Klystron output signal reflects back to the input, it causes oscillations within the tube which decrease the amplification. Attenuators can be placed to minimize the reflections, but the attenuators result in reduced gain which affects overall efficiency of the tube. Moreover, TWTs require external voltage sources and Klystrons are not able to provide high RF gain.

Therefore, to limit the aforementioned drawbacks, the present disclosure envisages an apparatus and a method for oscillation of charge and generation of electromagnetic waves. The apparatus of the present disclosure facilitates electron movement in an undulating path due to time varying magnetic field in a synchronized way so as to produce an oscillating electric field between two parallel metal plates in order to produce current in a loop attached to the plates to successfully extract the oscillating magnetic field from the loop space using a pickup loop/co-axial cable.

Figure 11:
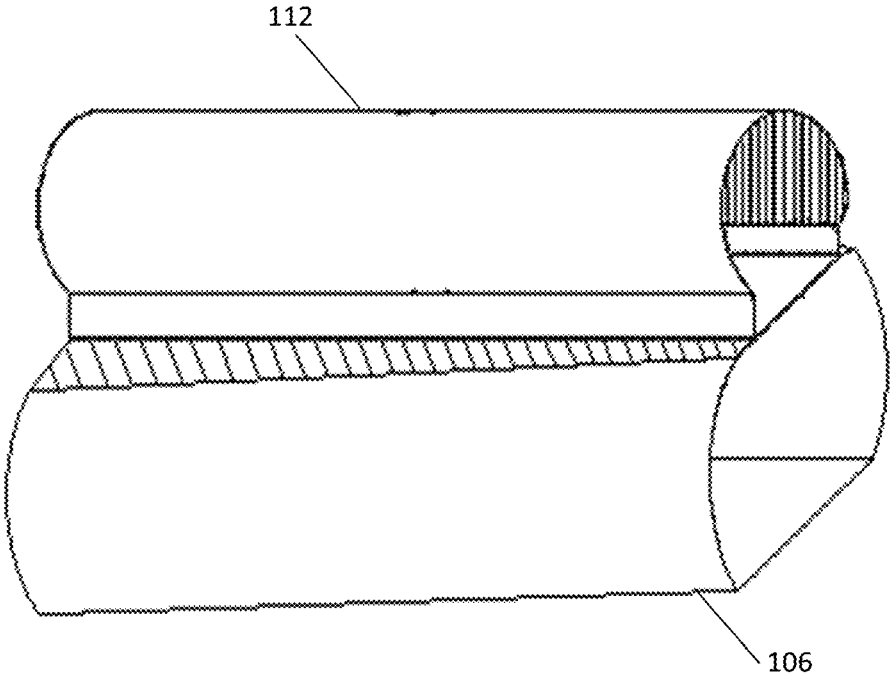
FIG. 11 illustrates a schematic diagram of a tapered evacuated envelope present in the apparatus of FIG. 1, in accordance with one embodiment.

Referring to the accompanying drawing, FIG. 1 of the accompanying drawing illustrates a schematic diagram of an apparatus 100 for generating electromagnetic waves, in accordance with an embodiment of the present disclosure. The apparatus 100 comprises an evacuated envelope 106, a pair of metal plates, a resonator 112, an electron gun 110, a magnetic field generator 130, and a pick-up loop 124. The evacuated envelope 106 defines a space 114 therewithin. In one embodiment, the evacuated envelope 106 is coupled between the electron gun 110 and a collector electrode 116. In another embodiment, a variable voltage is applied across the collector electrode 116 and a ground. In another embodiment, the electron gun 110 is selected from the group consisting of a thermionic electron gun, an electrostatic electron gun, and a laser driven electron gun. In yet another embodiment, side walls of the evacuated envelope 106 are tapered as illustrated in FIG. 11. The pair of metal plates is disposed in a spaced apart configuration within the space 114 thereby defining a passage therebetween. The resonator 112 is coupled to the pair of metal plates. In an embodiment, the width of the resonator 112 is smaller than the width of the evacuated envelope 106. In another embodiment, the resonator 112 includes a plurality of resonators. The electron gun 110 is configured to emit bursts of electrons 122 into the passage in a controlled manner. In an embodiment, a controller (not shown in the figures) is used to control the operation of the electron gun 110. In one embodiment, the bursts of electrons 122 travel along an undulating path under the influence of the time varying magnetic field. In another embodiment, the bursts of electrons 122 travel one cycle of oscillation in a fixed time period. The magnetic field generator 130 is configured to generate a time varying magnetic field across the passage, thereby imparting oscillations to the electrons for inducing an oscillating electric field between the pair of metal plates. The oscillating electric field is configured to induce a time varying current in the resonator 112 resulting in the generation of electromagnetic waves. The pick-up loop 124 is coupled to the resonator 112 and is configured to extract the generated electromagnetic waves.

The apparatus also includes a cathode 118, an anode 120, a very high voltage battery 126, a battery switch 128 and a magnetic field generator 130. The cathode 118 and the anode 120 act as the electron gun 110 to produce a high velocity stream of electrons. The cathode 118 is heated by a filament which produces electrons. When the battery switch 128 is in ON state, a high positive potential is applied at the anode 120, by the very high voltage battery 126, due to which the electrons are attracted to and pass through an anode cylinder 120*a*. The bursts of electrons 122 emitted by the electron gun 110 pass through a space 114 formed by two parallel metal plates (not shown in figure) of the evacuated envelope 106. The magnetic field generated by the magnetic field generator 130 alternates along the length of the evacuated envelope 106. In an embodiment, the at least one electromagnet of the magnetic field generator 130 includes a coil of wire wrapped around an iron core. The strength of the generated magnetic field is proportional to the amount of current through the coil. The bursts of electrons 122 traversing in the magnetic field are forced to undergo oscillations thereby inducing oscillating electric field in the metal plates and the pick-up loop 124 of the space 114. The oscillating field in the pick-up loop 124 is an amplified field. In one embodiment, the amplified field is extracted from the pick-up loop 124 through a coaxial cable. When bursts of electrons 122 pass through the space 114 and give up their energy, the lower energy electrons are absorbed by the collector electrode 116.

Figure 2:
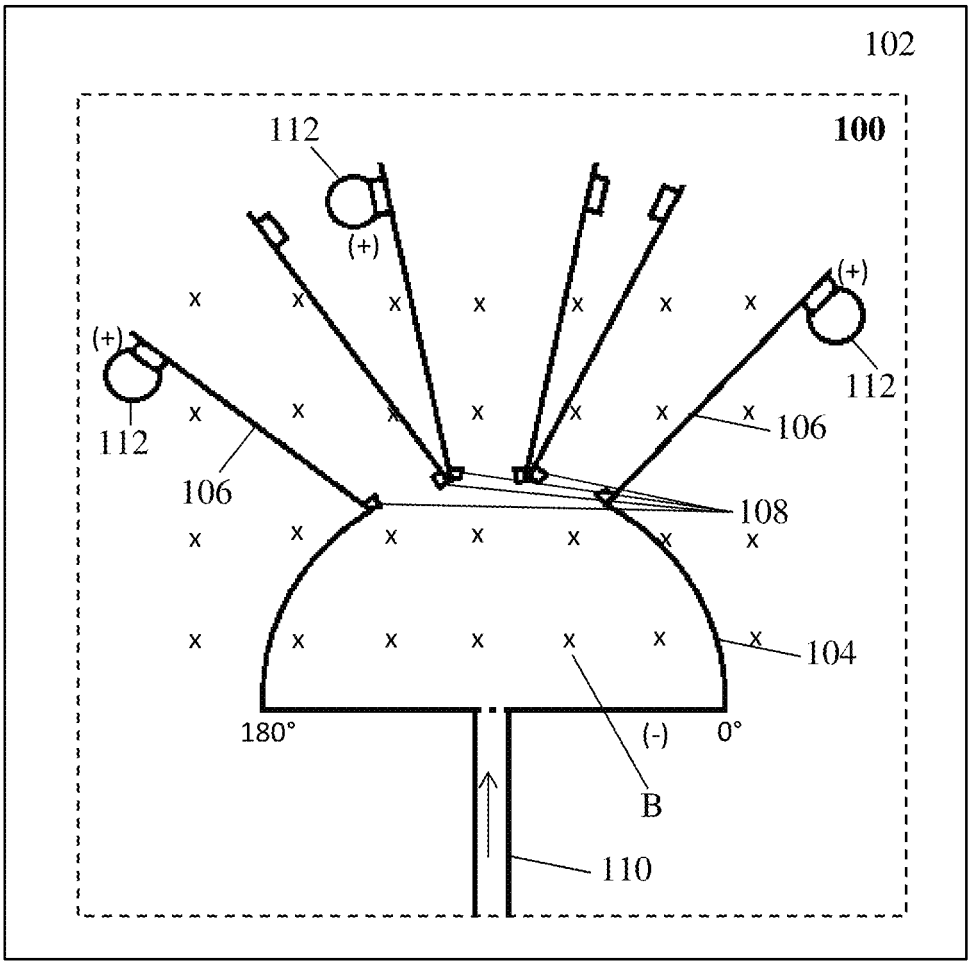
FIG. 2 illustrates a schematic diagram of an EM waves generating apparatus, in accordance with another embodiment of the present disclosure.

FIG. 2 illustrates a schematic diagram of an EM waves generating apparatus 100, in accordance with another embodiment of the present disclosure. The apparatus 100 includes a D shaped semi-circular section 104 (hereinafter known as D-shaped envelope), evacuated envelope 106 extending from perimeter of the D-shaped envelope 104, electron absorbing material 108 present at each intersection formed by the evacuated envelope 106 and the perimeter of the D-shaped envelope 104, at least one magnetic field generator (not shown in FIG. 2), the electron gun 110 emitting high velocity stream of electrons, and the resonator 112 present at a free end of the evacuated envelope 106. In one working example, the apparatus 100 of FIG. 2 is placed in a vacuum region 102. In one embodiment, the evacuated envelope 106 may be a waveguide or a wave tube. In another embodiment, the evacuated envelope 106 includes two parallel metal plates.

Figure 9:
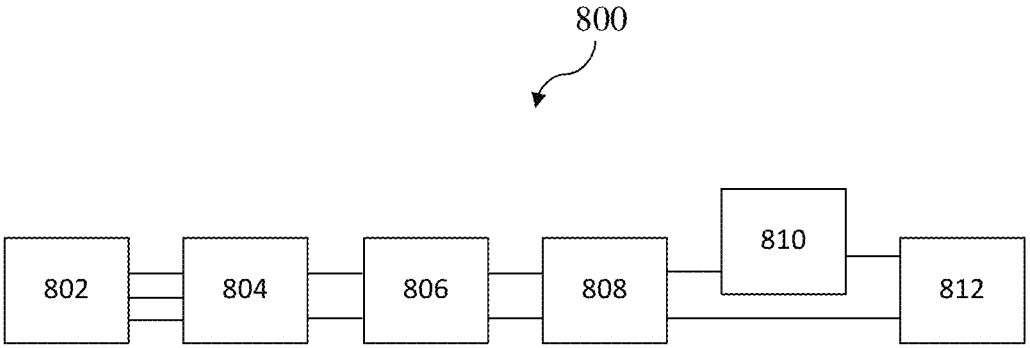
FIG. 9 illustrates a block schematic of a rectifier inverter limiter circuit in accordance with one embodiment of the present disclosure.
Figure 10:
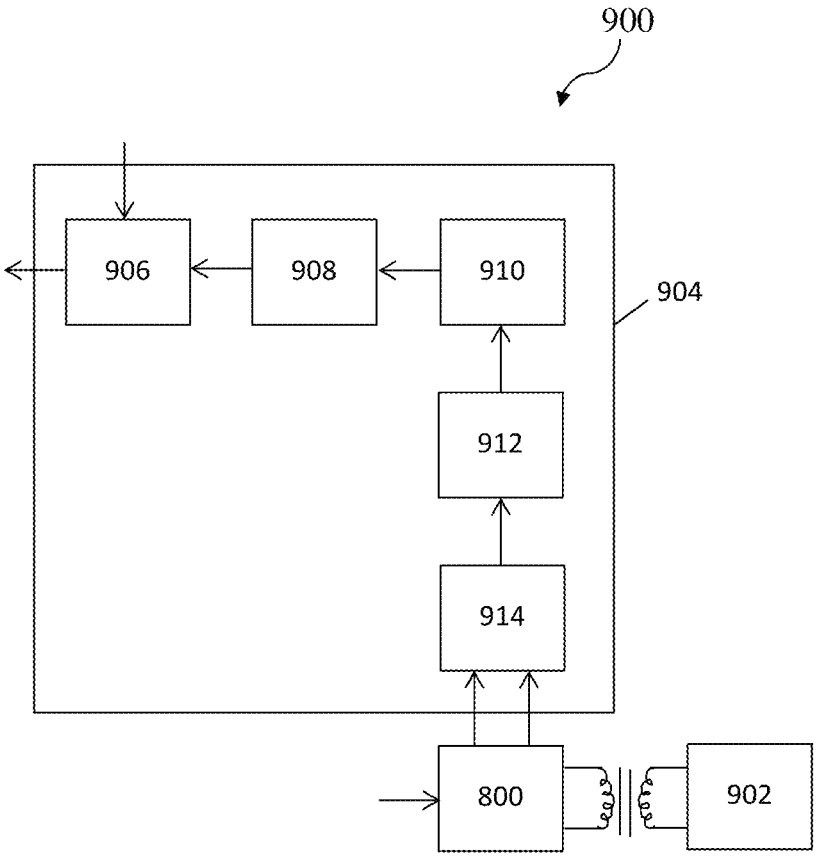
FIG. 10 illustrates a block diagram of a switch and magnetic field control circuit in accordance with one embodiment of the present disclosure.

Referring to the accompanying drawing, FIG. 9 illustrates a block schematic of a rectifier inverter limiter circuit 800 in accordance with one embodiment of the present disclosure and FIG. 10 illustrates a block diagram of a switch and magnetic field control circuit 900 in accordance with one embodiment of the present disclosure. The magnetic field control circuit 900 is configured to generate a control signal which is applied to at least one electromagnet of the magnetic field generator 130. The magnetic field generator 130 is configured to generate a time varying magnetic field oriented in a direction which is always transverse to the plane containing the apparatus 100. For example, at time $t=t_0$, the magnetic field may be penetrating inside (illustrated by 'x') the plane, and at $t=t_1$, the magnetic field may be coming out (illustrated by '.') of the plane. The magnetic field control circuit 900 includes the rectifier inverter limiter circuit 800, an autotransformer 902, and a signal processing circuit 904. In an embodiment, the input to the rectifier inverter limiter circuit 800 may be a 3 phase AC supply 802. The rectifier inverter limiter circuit 800 includes at least following components, namely, a 6 pulse controlled rectifier 804, an LC filter 806, a variable frequency inverter 808, a current limiter 810, and a tank circuit 812. The tank circuit 812 includes at least one capacitor in parallel with at least one inductor. The 3 phase AC supply 802 provides a three phase AC input to the 6 pulse controlled rectifier 804. The 6 pulse controlled rectifier 804 converts the AC input signal into a pulsating signal DC signal. The pulsating DC signal is applied to an input of the LC filter 806 which is configured to remove ripples present in the pulsating DC signal so as to generate a DC signal. The DC signal is converted in to an AC signal by the variable frequency inverter 808. An output of the variable frequency inverter 808 is coupled to an input of an analog filter 914, which is configured to filter the AC signal, via the current limiter 810, the tank circuit 812 and the autotransformer 902. An output of the analog filter 914 is connected at the input of an ADC 912. The ADC 912 includes a sample and hold circuit (not shown in figure) and a quantizer (not shown in figure). The ADC 912 is configured to convert the filtered AC signal into a digital signal. The digital signal is applied at an input of a frequency divider 910. An output of the frequency divider 910 is applied at an input of a digital filter 908. The output of the digital filter 908 is a square wave signal. In an embodiment the square wave signal is applied to a switch 906. In one embodiment, the switch 906 is an NMOS transistor, and the square wave output signal of the digital filter 908 is applied the at a gate terminal of the NMOS transistor. In an embodiment, Input Vin can be applied at a source terminal of the switch 906 (NMOS transistor) to obtain output Vout at the drain terminal of the NMOS transistor. In another embodiment, the switch 906 is a PMOS transistor and the square wave output signal is applied at a gate terminal of the PMOS transistor.

The electron gun 110 is configured to produce high velocity beams of electrons. In an embodiment, the electron gun 110 is adapted to scan the D-shaped envelope 104 in an anti-clockwise direction or a clockwise direction. Typically, the electron gun 110 includes a cathode and at least on anode. The cathode is heated by a filament that produces electrons which are attracted to and pass through the anode at a high positive potential. The magnetic field generated by the at least one magnetic field generator avoids random spreading of the electron beams. Further, if any electron beam disperses randomly, in a direction which is not in accordance with the desired direction for travel, then, such dispersed electron beam is absorbed by the electron absorbing material 108. In an embodiment, the desired direction of travel for the electron beam is a travel path in between two metal plates of the Evacuated envelope 106. In one embodiment, an outer periphery of the D-shaped envelope 104 holds a negative charge. In another embodiment, the angular displacement between successive electron travel paths in a pre-determined time period changes linearly with time ($\Delta t$) based on the respective time values at which each of the electron is emitted along a travel path.

The electron beam radiated from the electron gun 110 enters the region of the D-shaped envelope 104 wherein the electrons of the electron beam under the influence of the time varying magnetic field are forced to undergo oscillations thereby producing oscillating electric field between two parallel metal plates of the Evacuated envelope 106. The produced oscillating electric field between the two parallel metal plates generates current in a loop of the resonator 112 connected to the plates. Further, the phase of the generated electric field remains unchanged. The generated magnetic field in the loop is then picked up using a pickup loop or a co-axial cable. In an embodiment, the generated current is a time varying current which generates a time varying magnetic field in accordance with the Maxwell's equation.

The apparatus 100 causes successive acceleration of electrons, requiring a time varying magnetic field, eventually causing them to move in a curved path, primarily a wave. This is achieved by passing the electron beam in a time varying magnetic field (B) which exerts a Lorentz force on the electrons. The net work done by the electric field is nearly zero and its effects are neglected. The exerted force is therefore given by the following equations:

$$q(\overline{v}\times\overline{B}), \quad (1)$$

here $q = e$ and $B = B_0\sin(\omega_0 t)$ $$e(\overline{v}\times\overline{B}) = m_e\frac{v^2}{R}$$

$$\frac{eB}{m_e} = \frac{d\theta}{dt}$$

$$\int\frac{eB_0\sin\omega_0 t}{m_e}dt = \int d\theta$$

$$\theta_t = \frac{eB_0}{m_e}\int_0^t \sin\omega_0 t dt = \theta_t \quad (2)$$

Figure 3:
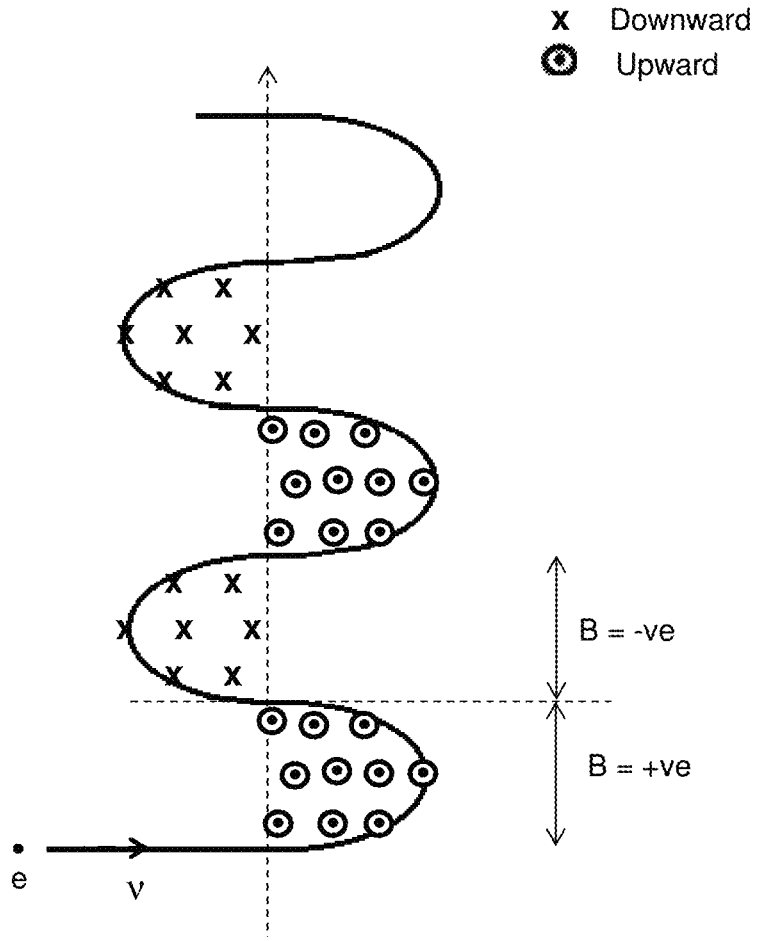
FIG. 3 illustrates electron oscillation, in accordance with one embodiment of the present disclosure.

Therefore, for an electron, time required to move along a path=half the time period $T_0$ of the wave, it should cover $\pi$ radian of angular displacement=$\theta_t$, as illustrated in FIG. 3.

Thus, by using equation (1)

$$\pi = \frac{eB_0}{m_e}\int_0^{\frac{T_0}{2}}\sin\omega_0 t dt \therefore \pi = \frac{2eB_0}{m_e\omega_0} \quad (3)$$

Hence, equation 3 provides a unique relation between the max value of magnetic field $B_0$ and $$\text{frequency of oscillation} = \frac{\omega_0}{2\pi} = f_0$$

Figure 4:
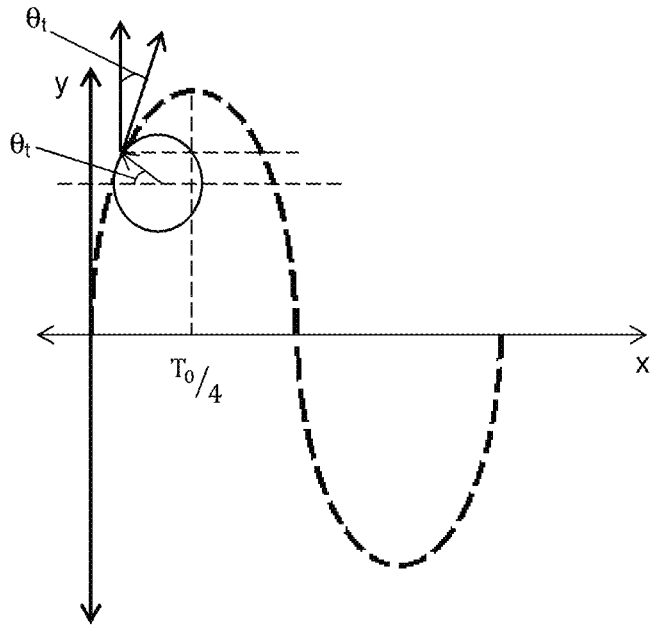
FIGS. 4 and 5 illustrate projectile/path travelled by an electron, in accordance with one embodiment of the present disclosure.
Figure 5:
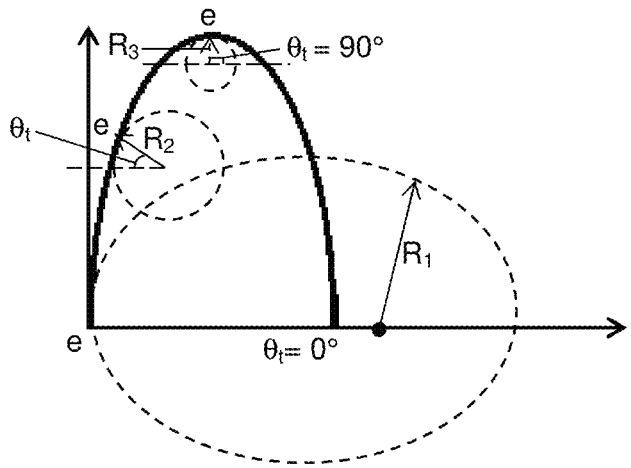

Referring to the accompanying drawing FIGS. 4 and 5 illustrate projectile of an electron in the apparatus 100. As it can be observed, the radius of curvature of the electron varies but the velocity is always tangent to the projectile. The velocity component along x-axis is v $\sin(\theta_t)$ and along y-axis is v $\cos(\theta_t)$. The horizontal component gives the wavelength and the vertical component gives the amplitude.

$$\theta_t = \frac{eB_0}{m_e}\int_0^t \sin\omega_0 t dt = \frac{eB_0}{\omega_0 m_e}[1-[\cos\omega_0 t]]_0^t = \frac{eB_0}{\omega_0 m_e}[1-\cos\omega t] \quad (4)$$

$$\therefore \text{ Amplitude} = \int_0^{\frac{T_0}{4}}(v\cos\theta_t)dt$$

$$\text{Since Amplitude} = \int v_y dt \quad (5)$$

$$\text{Amplitude} = v\int_0^{\frac{T_0}{4}}\cos\left(\left[\frac{eB_0}{\omega_0 m_e}[1-\cos\omega_0 t]\right]\right)dt$$

$$\text{Velocity along } x = v_x = v\sin\theta_t$$

$$\therefore \text{ Wavelength} = 4\times v\int_0^{\frac{T_0}{4}}\sin\left(\left[\frac{eB_0}{m_e\omega_0}[1-\cos\omega_0 t]\right]\right)dt$$

Equations 4 and 5 are obtained by assuming constant velocity throughout.

In another embodiment, the aforementioned equations may be modified using time dependent velocity of an electron flowing in the apparatus.

Figure 6:
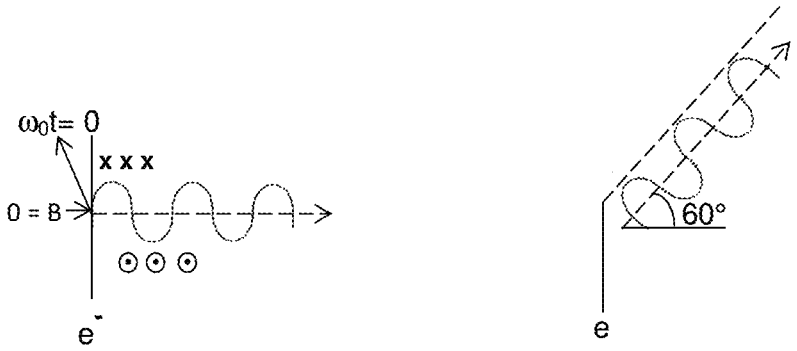
FIGS. 6 and 7 illustrate deflection of electron in magnetic field, in accordance with one embodiment of the present disclosure.
Figure 7:
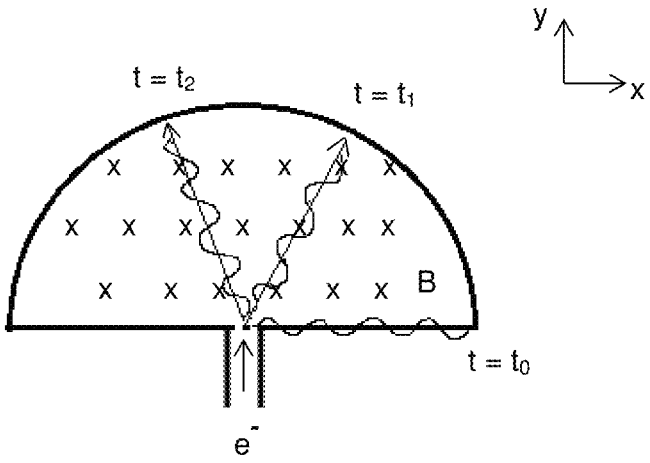

Since the electrons in the electron beam are entering continuously in the D-shaped envelope 104, there will be angular displacement of electrons in the D-shaped envelope 104. This phenomenon occurs owing to the value of magnetic field being different at different times, as illustrated in FIGS. 6 and 7. Thus, multiple tubes may be required to tap in the energy of electrons. Each of these tubes is surrounded by a resonant space with the tube itself being the capacitor equivalent.

Figure 8:
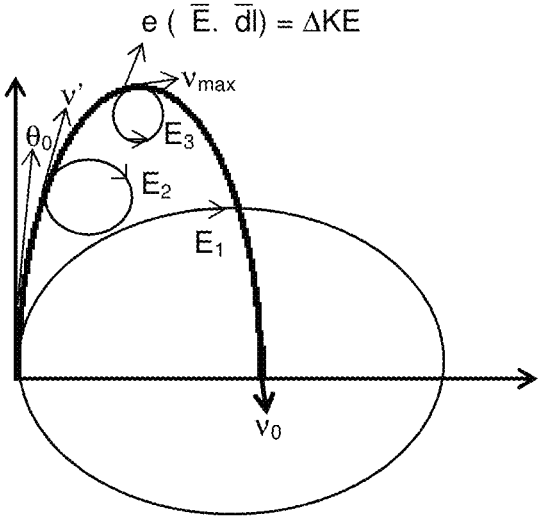
FIG. 8 illustrates electric field contribution, in accordance with one embodiment of the present disclosure.

Effect of the electric field is illustrated in FIG. 8. The time varying magnetic field produces an induced electric field as given by the Maxwell's equations.

$$\frac{d\phi}{dt} = \int E\cdot dl$$

Since, flux $\propto$B $$\therefore \frac{d\phi}{dt} = KB_0\cos\omega_0 t$$

since, $\cos(\omega_0 t)$ is positive for 0° to 90° and negative from 90° to 180°.

Therefore, net work done by electric field in half time period is zero and final velocity=initial velocity, when the velocity of the electron is significantly less than the speed of the light. But, this may lead to an increase or change in wavelength and amplitude, whereas, the frequency of oscillation remains unaffected.

In one embodiment, the undulating path of the bursts of electrons 122 is verified by using COMSOL Multiphysics Simulation software. In the simulation, the particle configuration is modified to verify if the result is as desired. Here, the particle refers to ions/electrons/plasma that follows an undulating path in such a way that the time period of its wave like motion is always constant even if its velocity changes. For simulation, the particle properties are changed as follows:

Ion mass (mp)=$6.6422\times10^{-26}$ kg

Magnetic Flux (B)=2[T]

Particle velocity (v0)=2000 m/s

Larmor radius (rL)=$4.1457\times10^{-4}$ m

Then z-component of the particle velocity is made zero so that it remains in x-y plane. Angular frequency $\omega_0$ is then calculated with the help of aforementioned equation (3), wherein applied oscillating magnetic field=$B_0$ $\sin(\omega_0 t)$, where, $B_0$ is 2T. By the equation (3), the angular frequency ($\omega_0$) is 3071203.006 Hz and the frequency is 488797.1396 Hz. These values are then used for simulation.

Figure 12:
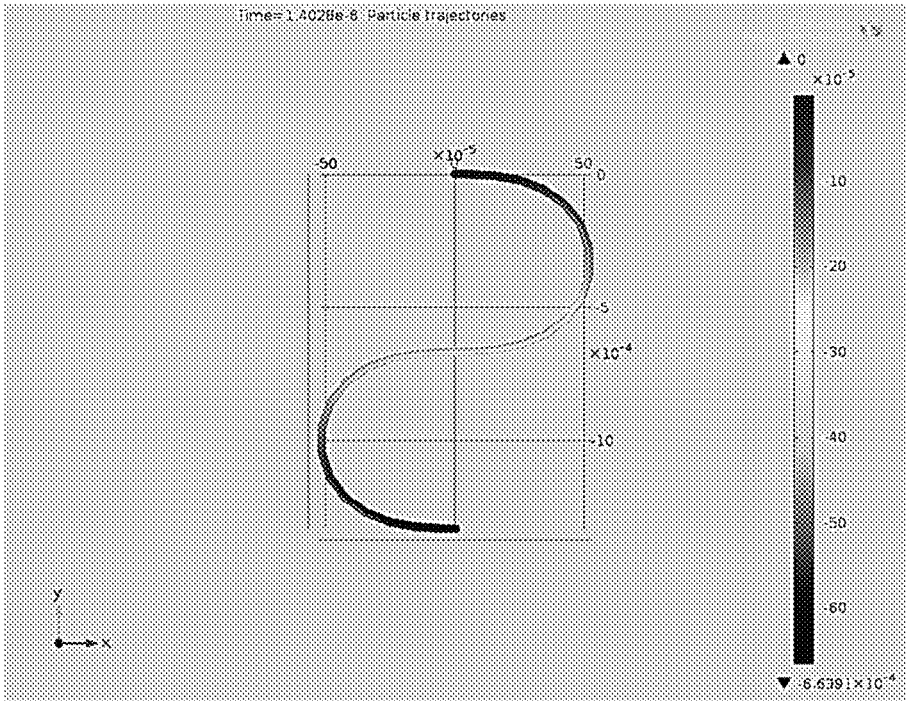
FIG. 12 illustrates a graphical diagram of simulated trace of a particle (electron).

The result of this simulation as illustrated in FIG. 12, shows that the expected path of the particle trajectory completely matches the simulated path. Further, it is observed that the particle initially and after every half time period has its direction tangent at 90 degrees to the axis which is not the case in sine wave wherein the direction tangent is at 45 degrees. This is one of the most important characteristics of the undultory motion of the particle. Since velocity is not changed as the time progresses, there is no dampening effect of the particle.

In the typical electron vacuum tubes like TWTs or Klystrons, all the electron velocity is concentrated in x direction whereas, in the apparatus 100 of the present disclosure, only a fraction of velocity is in x direction. Therefore, more energy is stored per unit volume and longer time is available to extract the kinetic energy of electrons.

Technical Advancements

The present disclosure described herein above has several technical advantages including, but not limited to, the realization of an apparatus for generating electromagnetic (EM) waves, which:

provides efficient radio frequency amplification;

facilitates low loss EM generation;

enables almost complete utilization of kinetic energy of electrons; and works for different radio frequencies, by changing tapping of coil used for producing magnetic field and the inverter frequency.

The disclosure described herein with reference to the accompanying embodiments does not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

The invention claimed is:

1. An apparatus for generating electromagnetic waves, said apparatus comprising:

an evacuated envelope defining a space therewithin;

a pair of metal plates disposed in a spaced apart configuration within said space thereby defining a passage therebetween;

a resonator coupled to said pair of metal plates;

an electron gun configured to emit bursts of electrons into said passage in a controlled manner;

a magnetic field generator configured to generate a time varying magnetic field, oriented in a direction transverse to the X-Y plane containing said apparatus across the passage, thereby imparting oscillations to the electrons for inducing an oscillating electric field between said pair of metal plates, said oscillating electric field configured to induce a time varying current in said resonator resulting in the generation of electromagnetic waves; and a pick-up loop coupled to said resonator and configured to extract said generated electromagnetic waves, wherein said bursts of electrons travel along an undulating path under the influence of said time varying magnetic field, and wherein said bursts of electrons travel one cycle of oscillation in a fixed time period.

2. The apparatus as claimed in claim 1, wherein said evacuated envelope is coupled between said electron gun and a collector electrode.

3. The apparatus as claimed in claim 1, wherein said electron gun is selected from the group consisting of a thermionic electron gun, an electrostatic electron gun, and a laser driven electron gun.

4. The apparatus as claimed in claim 1, wherein the width of the resonator is smaller than the width of the evacuated envelope.

5. The apparatus as claimed in claim 1, wherein side walls of said evacuated envelope are tapered.

6. The apparatus as claimed in claim 1, which includes a D-shaped envelope coupled between said electron gun and at least one evacuated envelope.

7. The apparatus as claimed in claim 6, wherein the electron gun is configured to emit high velocity stream of electrons.

8. The apparatus as claimed in claim 7, wherein the angular displacement between successive electron travel paths changes linearly with time.

* * * * *